US005354099A

United States Patent [19]

Kaule et al.

[11] Patent Number: 5,354,099

[45] Date of Patent: Oct. 11, 1994

[54] MAGNETIC METALLIC SAFEGUARDING THREAD WITH NEGATIVE WRITING

[75] Inventors: Wittich Kaule, Emmering; Michael Boehm, Heimstetten, both of Fed. Rep. of Germany

[73] Assignee: GAO Gesellschaft fur Automation Und Organisation MBH, Munich, Fed. Rep. of Germany

[21] Appl. No.: 920,574

[22] PCT Filed: Dec. 18, 1991

[86] PCT No.: PCT/EP91/02437

§ 371 Date: Sep. 30, 1992

§ 102(e) Date: Sep. 30, 1992

[87] PCT Pub. No.: WO92/11142

PCT Pub. Date: Jul. 9, 1992

[30] Foreign Application Priority Data

Dec. 20, 1990 [DE] Fed. Rep. of Germany ... P4041025.0

[51] Int. Cl.[5] ..... B42D 15/02; B05D 5/12

[52] U.S. Cl. ..... 283/85; 283/82; 283/83; 428/915; 427/131; 427/282; 427/511

[58] Field of Search ..... 283/57, 58, 72, 82, 283/83, 85, 91; 160/140; 428/208, 209, 915, 916; 427/131, 282, 286, 376.6, 383.1, 511, 555, 548

[56] References Cited

U.S. PATENT DOCUMENTS

| | | | |
|---|---|---|---|
| 4,183,989 | 1/1980 | Tooth | 428/916 X |
| 4,428,997 | 1/1984 | Shulman | 428/915 X |
| 4,455,039 | 6/1984 | Weitzen et al. | 283/58 |
| 4,507,346 | 5/1985 | Maurer et al. | 427/510 |
| 4,609,207 | 9/1986 | Muck et al. | 283/85 X |
| 4,631,222 | 12/1986 | Sander | 283/82 X |
| 4,941,687 | 7/1990 | Crane . | |
| 4,943,093 | 7/1990 | Melling et al. | 283/91 X |
| 5,113,062 | 5/1992 | Fujita et al. | 427/131 X |

FOREIGN PATENT DOCUMENTS

| | | |
|---|---|---|
| 0185396 | 6/1986 | European Pat. Off. . |
| 0310707 | 12/1989 | European Pat. Off. . |
| 0377160 | 7/1990 | European Pat. Off. . |
| 0381112 | 8/1990 | European Pat. Off. . |
| 0400902 | 12/1990 | European Pat. Off. . |
| 1127043 | 9/1968 | United Kingdom . |
| 1411477 | 10/1975 | United Kingdom . |

OTHER PUBLICATIONS

WO 90/13877, Klunker et al., Nov. 1990.

*Primary Examiner*—Timothy V. Eley
*Assistant Examiner*—K. V. Nguyen
*Attorney, Agent, or Firm*—Bacon & Thomas

[57] ABSTRACT

The invention relates to a security document, in particular a bank note, identity card or the like having a security element which is provided with characters, patterns, etc., visually readable at least in transmitted light and which is electrically conductive and bears additional substances for machine testing, and to a method for producing such a security element. The security element comprises a transparent film strip that bears negative writing readily capable of visual checking and is additionally provided with electrically conductive and magnetic substances.

29 Claims, 3 Drawing Sheets

MAGNETIC METALLIC SAFEGUARDING THREAD WITH NEGATIVE WRITING

The present invention relates to a security document, in particular a bank note, identity card or the like, having a security element which is provided with characters, patterns, etc., visually readable at least in transmitted light and which is electrically conductive and bears additional substances for machine testing, and to a method for producing such a security element.

German patent no. 27 54 267 discloses equipping a security element, generally referred to as a safeguarding thread, with several security features. In particular this publication describes the combination of a magnetic authenticity feature with another physical feature, such as electric conductivity or luminescence. An important selection criterion for the security features to be combined is that these features not be readily recognizable and imitatable by a forger. This requirement of course increases the protection against forgery. However, it also means that an average persons who handles such security documents are likewise unable to detect these security features and that security documents equipped with such a thread cannot be checked for authenticity without suitable machines.

To avoid this disadvantage EP-A 0 330 733 therefore proposes a security element that can be checked both visually and by machine. For this purpose a transparent plastic film is metal-coated and this coating is provided with recesses in the form of characters or patterns. The safeguarding thread also contains a chromophore and/or luminescent substances in the areas congruent with the recesses for making the characters or patterns contrast in color with the opaque metallic coating under suitable light conditions. A special method is used for producing the recesses, the so-called negative writing. Before the thread material is metalized, a printed image is applied in accordance with the later recesses and only then the metallic coating is applied. The printed image is applied using inks or lacquers that can be chemically dissolved again under the metallic coating, giving rise to recesses in the metallic layer at those places in the printed image since the metallic layer is removed along with the ink.

The safeguarding thread described in EP-A 0 330 733 meets a very high security standard. On the one hand, the electric conductivity can be checked by machine via the uninterrupted metallic coating and, on the other hand, the negative writing serves as a visual authenticity feature well recognizable to the viewer. Furthermore, the thread has an additional feature not readily recognizable to the viewer, namely luminescence in the area of the negative writing that can likewise be checked by machine. However, it is disadvantageous that a testing device must have both a conductivity sensor and an optical sensor for detecting the two machine-testable properties. Optical sensors are relatively elaborate and voluminous due to the necessary light source, lens systems, filters, etc. This makes the testing device accordingly elaborate and large.

The invention is therefore based on the problem of providing a security element for security documents having at least two machine-testable security features that avoids the abovementioned disadvantages and nevertheless combines the advantages of the visual and machine testability.

This problem is solved by the features stated in claims 1, 21 and 22.

The essence of the invention is the combination of a magnetic security feature with negative writing that offers several advantages. Firstly, the inventive security element advantageously combines the positive aspects of prior art security elements, fast and simple visual checking, on the one hand, and the possibility of machine testing that is not readily recognizable from the outside, on the other. This is because the negative writing, that is embedded in reflective surroundings, is readily detected by the human eye and can be easily checked for authenticity by the viewer. It is additionally possible to support, or possibly revise, the visual test result for the security document by machine, using a magnetic field measurement. The metallically reflective surroundings of the negative writing ensures that the safeguarding thread does not impair the general impression of the data carrier or security document in incident light but is very striking in transmitted light.

Furthermore, many coding possibilities are available for the detection of magnetic properties in contrast to luminescence since a forger is unable to detect which of the magnetic properties, such as permeability, magnetization, remanence, etc., is used as a test criterion. The protection against forgery can thus be increased even further by the use of a magnetic authenticity feature.

Since electric conductivity and magnetic properties can be measured at relatively low hardware expense, one obtains the further economic advantage that the inventive security element can be checked by a relatively simple sensor despite the variety of test options (electric conductivity and a magnetic property), at least two of which are machine-detectable. This results in multiple and therefore increased protection from forgery without any additional changes in the testing device or costs.

In a possible embodiment of the inventive security element a synthetic thread is both metal-coated and printed with magnetic ink, the magnetic and metallic areas being disposed e.g. alternatingly on the thread regarded in the longitudinal direction thereof. However, the metallic and magnetic areas can optionally also be applied in the longitudinal direction or provided in superposed layers. In all cases the metalization bears negative writing, as is known from EP-A 0 330 733.

In a preferred embodiment the machine-testable magnetic ink is present as an all-over coating below the metalization, that is interrupted only in the area of the negative writing which is applied by the inventive method.

With the hitherto known method for producing a security element with negative writing, as described e.g. in EP-A 0 330 733, it was not possible to include an all-over magnetic ink in the structure of the security element. Due to its reflective properties, the metalization must constitute the outermost layer of the security element so that the opaque magnetic ink must necessarily be printed between the soluble ink, that later produces the negative writing, and the metallic coating. However, the magnetic ink is relatively scantily soluble. It is therefore impossible to produce the negative characters by the known method since the magnetic layers cannot, or not completely, be dissolved out of the layer structure and the contours of the writing thus only appear incompletely.

By contrast, the inventive method is particularly suitable for an all-over magnetic layer structure combined with electrically conductive layers, The inventive method applies the negative print using a heat-softening or vaporable ink instead of chemically soluble inks.

Since safeguarding threads are produced in sheets and then cut into strips of predetermined width the inventive method offers the advantage that both the magnetic ink and the metalization can be applied all over regardless of the negative print located therebelow, This makes the method very efficient and thus also inexpensive, Examples of the method and developments of the invention shall be explained in the following with reference to the figures, For the sake of clarity the figures do without true-to-scale and true-to-proportion representations,

DETAILED DESCRIPTION

Figure 1:
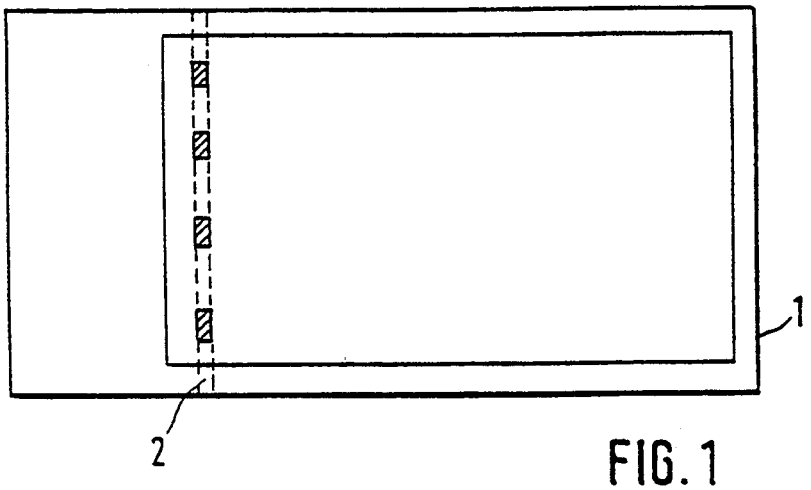
FIG. 1 shows a bank note with an embedded safeguarding thread.

FIG. 1 shows a paper of value 1 with an embedded security element 2 designed as a so-called window safeguarding thread. This embodiment ensures that the element is well visible at least in certain areas both in incident and in transmitted light. The safeguarding thread is quasi woven into the paper stuff so that it passes directly to the document surface at regular intervals, which is indicated by the shaded boxes.

Figure 2:
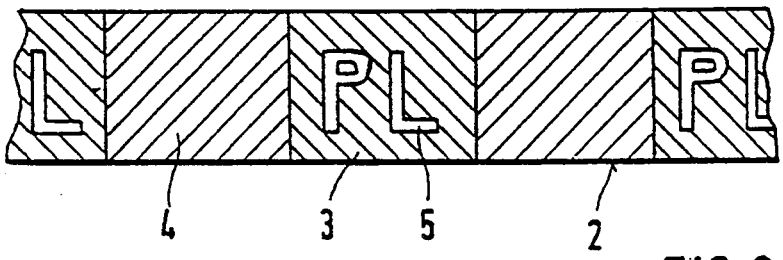
FIG. 2 shows a front view of the safeguarding thread in an inventive embodiment.
Figure 3:
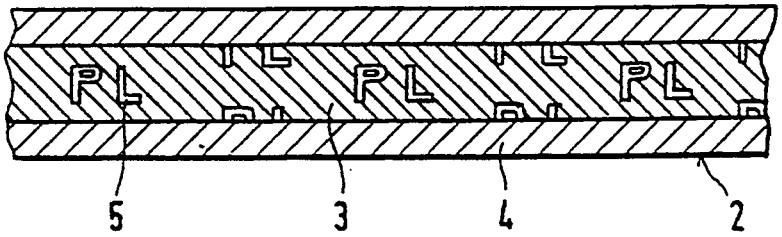
FIG. 3 shows a front view of a further possible embodiment of the inventive safeguarding thread.
Figure 4:
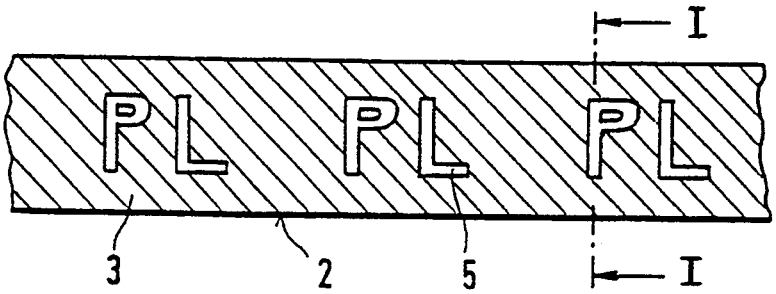
FIG. 4 shows a front view of a further variant of the inventive safeguarding thread, FIG, 5 shows section 1—1 of the variant of the inventive safeguarding thread shown in FIG. 4 before application of the negative writing.

FIGS. 2, 3 and 4 show possible embodiments of inventive security element 2 in a front view.

FIG. 2 shows security element 2, comprising a transparent plastic film provided with metallic and magnetic areas 3, 4 alternating in the longitudinal direction. Metalization 3 has recesses 5, the so-called negative writing, in the form of any characters, numbers or patterns, etc., in which the transparent carrier material located thereunder is visible. Metallic areas 3 are separated by bars of usually black printed magnetic ink 4.

Such a thread can be produced in various ways. For example, a plastic film can be metal-coated all over and then be provided with negative writing by a method known from EP-A 0 330 733. The text is applied alteratively in a parallel line and column arrangement. Bars of magnetic ink are applied over this film at appropriate intervals parallel to the columns so that the negative writing appears at least once completely between these bars. In the last step the sheet is cut into threads parallel to the lines in exact register, as known for example from EP-A 0 381 112.

Alternatively, the text can be applied in a parallel column arrangement in such a way that it is shifted by half a line in adjacent columns, as shown in FIG. 3. The bars of magnetic ink 4 can also be printed on parallel to lines of writing 3, as likewise apparent from FIG. 3. In this case one must make sure the magnetic strides are disposed in lateral register with the negative writing. The plastic film otherwise prepared as in the above-described method is cut into threads with a width of about 1.2 mm, whereby metalization 3, which is about 0.8 mm wide and bears visible negative writing 5, is framed symmetrically by magnetic stripes 4 having a width of about 0.2 mm.

A further embodiment of the inventive security element is shown in FIG. 4. In its external appearance this safeguarding thread 2 does not differ from known safeguarding threads. One can recognize only transparent writing 5 in its metallic surroundings 3. The differences become apparent, however, when one considers the layer structure of thread 2.

Figure 5:
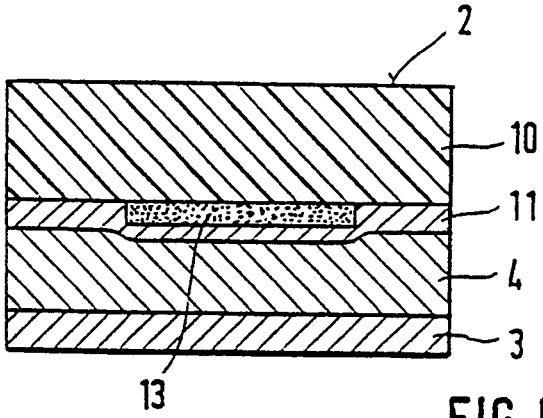
Figure 6:
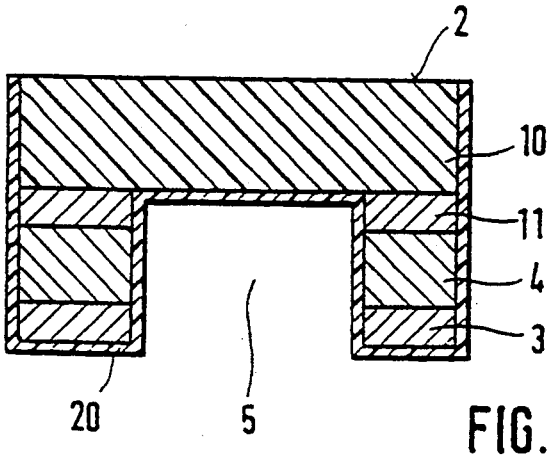
FIG. 6 shows section A—B after application of the negative writing.

FIGS. 5 and 6 show section A—B of the preferred embodiment of inventive security element 2 shown in FIG. 4 before and after the application of negative writing 5. As in the previous examples, a transparent plastic film 10 serves as the carrier material. It is first printed with an activatable ink 13 in the area of the later negative writing. The film is then vacuum coated with metal 11. e.g. aluminum, all over. A magnetic ink 4 is likewise provided all over this layer structure. The outermost layer constitutes a further vacuum metalized metalization 3.

The drawing permits no estimation of the individual layer thicknesses, so that some typical data shall be stated for illustration in the following. Carrier film 10 has a thickness of about 10 to 30 micrometers, activatable ink 13 ranges between 0.5 and 2 micrometers, while each of the metalizations is only about 1/100 micrometer thick and the magnetic ink has a layer thickness of 1 to 5 micrometers.

The inner metallic coating ensures that the safeguarding thread offers the same external appearance regardless of the side due to the transparency of the carrier material. This is necessary to .permit the thread to be checked in the same way after it is embedded in the document.

Activation of ink 13 gives rise to recesses congruent to the ink in the three layers 11, 4 and 3 thereabove, thereby forming negative writing 5. To protect the thin metallic layer and the recesses one can spray on a transparent layer of lacquer 20 with a thickness of about 10 micrometers in a last step before cutting the sheet. On the other hand, it is also possible to provide the finished thread, as indicated in FIG. 6, with a protective layer by immersion.

Suitable activatable inks are e.g. wax-bearing emulsions like those used for transfer bands. When heated, these emulsions soften, thereby reducing their adhesion to the carrier film, so that both the softened ink and the layers located thereabove can be removed in these poorly adhesive areas, supported by mechanical treatment such as ultrasound, brushing or rubbing.

However, the inks for applying the negative image can also contain foaming additives as are customary in the production of foamed materials. These foaming agents split off gas under the action of heat and produce foam structures in a polymeric matrix. The decomposition process takes place irreversibly and within a predefined temperature interval. Foaming agents with an activation temperature around 200° C., e.g. azodicarbonamide, are particularly suitable in connection with the invention. As in the case of wax-bearing emulsions, the evolution of gas and the resulting increase in volume reduce the adhesion to the carrier film. In addition the layers located thereabove bulge outward in accordance with the increase in volume of the ink, thereby offering the mechanically acting treatment methods a good point of attack so that the negative writing can be brought out clearly. Alternatively, the foaming agent can also be admixed to the printable color in a microencapsulated form.

One can simplify the structure of the series of layers shown in FIG. 3 by adding a solvent for the metallic layers to the above-described activatable inks. It suffices if the ink is slightly acidic or alkaline since vacuum metalized aluminum is solely used in practice. In this way one can apply the first metallic coating directly to the carrier film and only then print on the printed image as it is later to appear as a negative image, thereby permitting the layers to be detached even more easily. This is because the detaching ink acts here virtually from the middle in two opposite directions, which makes the detachment of the layers more effective before the mechanical treatment. Acid or alkali residues in the thread need not be feared since the negative writing is washed with water following separation.

The activation of the ink producing the negative writing can of course also be triggered by other physical effects, such as a laser beam, electron beam, pressure, cold, etc.

The inventive method is also useful for producing a printed image with an ink layer, instead of a metallic layer, which is not printable itself but applied e.g. only by doctoring or other all-over coatings. In this case a negative print is printed under the ink according to the invention and the print removed according to the invention.

Figure 7:
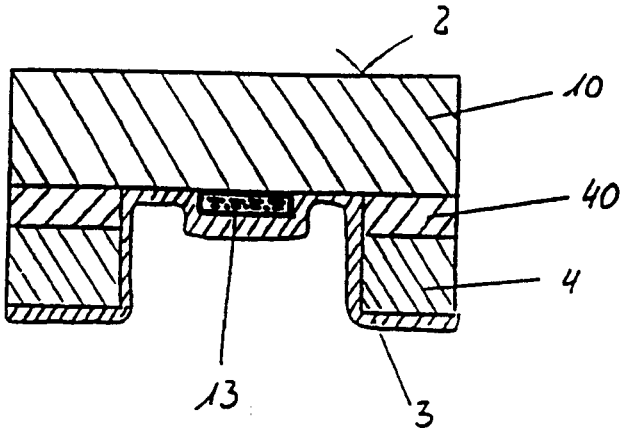
FIG. 7 shows section A—B of a variant of the structure of the thread shown in FIG. 4.

FIG. 7 shows a variant of the structure of security element 2 shown in a front view in FIG. 4, whereby the negative writing can be produced using not only the abovementioned activatable inks but also prior art chemically soluble inks. In this case carrier material 10 is printed in a multicolor printing machine with metallic strides 40 and with magnetic ink 4 congruent thereto. Activatable ink 13 producing the negative writing is applied in the gaps between the strides in a third printing unit. The thus prepared carrier material is given an all-over metallic coating 3 that is then removed in the area of the negative writing by activating ink 13. As in the previous example, the thread can also be provided with a protective transparent layer of lacquer here.

Metallic strides 40 are printed using a bronze ink, whereas the outer metallic coating preferably consists of vacuum metalized aluminum.

Figure 8:
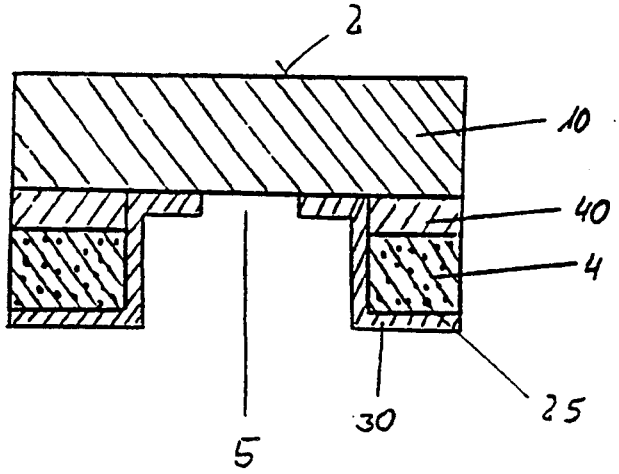
FIG. 8 shows section A—B of a further variant of the structure of the thread shown in FIG. 4.

FIG. 8 shows a similar thread structure but it can be produced, in contrast to the above-described methods, without using an activatable ink. As with the thread shown in FIG. 7, carrier material 10 is first printed with metallic strides 40 and with magnetic ink 4 congruent thereto. In a third printing unit a bronze ink, e.g. silver bronze, is then printed on in such a way as to have recesses in the form of negative characters 5.

In this example bronze inks or imitation metal inks, e.g. silver bronze, are used for both metalizations 40, 30. Such inks can of course also be used advantageously in the other examples described.

In all above examples of the inventive security element, the electric conductivity is determined by the properties of the metallically reflective layers, in particular readily visible layers 3. However, variants are also possible in which the conductivity is produced, or at least supported, by suitable admixture of electrically conductive material to the magnetic layer. Reference number 25 in FIG. 8 indicates such an admixture, that can consist for example of carbon black particles.

This additionally has the advantage that cracks in the metallically conductive layer extending over the total thread width, e.g. in layer 3 of the thread shown in FIG. 4, do not lead to a complete loss of electric conductivity. This is because the current flow in this case extends through the adjacent conductive magnetic layer, thereby bridging the crack. This makes it possible to use the feature of electric conductivity as an authenticity feature even when the layer to be checked has defects.

If lower demands are made on the signal magnitude of the electric conductivity and the magnetism it is also possible to add both the electricity conductive and the magnetic pigments to one ink, that is printed onto the carrier material leaving the negative writing blank. This offers the advantage that the thread material can be provided with the three security features, electric conductivity, magnetism and negative writing, in one printing operation.

It is also possible to distribute the features over only two layers. The carrier material is provided here in a first step with a partly permeable, electrically conductive layer, such as a very thin vacuum metalized or sputtered metallic or oxide layer. This layer bears primarily the electric conductivity. Over it a bronze layer, i.e. a metallic or imitation metal ink, is then printed leaving the negative writing blank. In this way one can produce a greater electric signal and nevertheless dispense with one method step.

Instead of the magnetic material one can of course also use any other machine-testable substance.

We claim:

1. A method for producing a security element to be incorporated into a security document and provided with indicia that are readily visible, both in transmitted light and in incident light, and machine testable, comprising the steps of:

providing one side of a transparent carrier film with a machine testable substance in mutually spaced regions with gaps between said spaced regions, printing the carrier film in the gaps between the regions with an activatable ink in the form of the readable indicia, providing the side of the carrier film bearing the activatable ink with a metallic layer over the entire carrier film, then activating the activatable ink, giving rise to recesses in the form of the indicia in the metallic layer, and cutting the film into strips of suitable width.

2. The method of claim 1, in which the metallic layer is a vacuum metallized layer, selected from a group consisting a bronze ink or an imitation metal ink.

3. The method of claim 1, which includes mixing the machine testable substance with an electrically conductive material prior to application to the transparent carrier film.

4. The method of claim 1, which includes mixing the machine testable substance with carbon black particles prior to application to the transparent carrier film.

5. The method of claim 1, in which the detachment of the layers over the carrier film is supported by ultrasonics, brushing, or rubbing.

6. The method of claim 1, in which the activatable ink is a wax bearing emulsion or contains formable additives.

7. The method of claim 6, in which the formable additives are present in the ink in the form of microcapsules.

8. The method of claim 1, which comprises activating the activatable ink by a laser beam, use of heat, an electron beam, a coolant, or by pressure.

9. The method of claim 1, which comprises providing a metallic layer between the carrier film and machine testable substance in exact register with the machine testable substance.

10. The method of claim 1, which comprises applying a protective transparent layer of lacquer prior to the last method step.

11. A method for producing a security document with a security element being provided with indicia that are visually readable at least in transmitted light and being machine testable, comprising the steps of:

printing a transparent carrier film with an activatable ink in the form of readable indicia, applying a metallic layer over the entire carrier film, activating the ink to produce recesses in the form of the indicia in the metallic layer, applying a magnetic substance over partial areas of the carrier film, cutting the film into strips of suitable width, and embedding at least one strip at least partially into a security paper during paper manufacture.

12. The method of claim 11, in which the indicia are printed in the form of parallel lines and columns.

13. The method of claim 11, in which the indicia are applied in parallel columns and shifted by half a line.

14. The method of claim 11, in which the magnetic substance is applied in bars parallel to the columns.

15. The method of claim 11, in which the magnetic substance is applied in stripes parallel to the lines.

16. The method of claim 11, in which the magnetic substance is mixed with electrically conductive material.

17. The method of claim 11, in which the magnetic substance is mixed with carbon black particles.

18. The method of claim 11, in which the activatable ink contains chemical solvents.

19. A method for producing a security document with a security element being provided with indicia that are visually readable at least in transmitted light and being machine testable, comprising the steps of:

printing a transparent carrier film with an activatable ink in the form of the indicia, providing the side of the carrier film bearing the activatable ink with a machine testable substance over the entire carrier film, applying a metallic layer over the entire machine testable substance, then activating the activatable ink to remove portions of all layers on the carrier film giving rise to congruent recesses in the form of the indicia in the metallic layer and the machine testable substance, cutting the film in strips of suitable width, and embedding the strips at least partially into a security paper during paper manufacture.

20. The method of claim 19, in which the metallic layer is selected from a group consisting of a vacuum metallized layer, a bronze ink or an imitation metal ink.

21. The method of claim 19, which comprises mixing the machine testable substance with an electrically conductive material prior to application to the transparent carrier film.

22. The method of claim 19, which comprises mixing the machine testable substance with carbon black particles prior to application to the transparent carrier film.

23. The method of claim 19, in which the machine testable substance is a magnetic ink.

24. The method of claim 19, in which the activatable ink is selected from a group consisting of wax bearing emulsions or foamable additives.

25. The method of claim 24, in which the foamable additives are present in the ink in the form of microcapsules.

26. The method of claim 19, which comprises activating the activatable ink by a laser beam, use of heat, electron beam, a coolant or by pressure.

27. The method of claim 19, in which a further metallic layer is provided congruently underneath the magnetic substance and on top of the activatable ink.

28. The method of claim 19, which comprises applying a protective transparent layer of lacquer prior to the last method step.

29. A method for producing a security document with a security element being provided with indicia that are visually readable at least in transmitted light and being machine testable, comprising the steps of:

providing a transparent carrier film with a machine testable substance in mutually spaced regions with gaps between said spaced regions, printing the carrier film in the gaps between the spaced regions with an activatable ink in the form of the readable indicia, providing the side of the carrier film bearing the activatable ink with a metallic layer over the entire carrier film, then activating the activatable ink, to remove portions of the layers on top of the activatable ink giving rise to recesses in the form of the indicia in the metallic layer, cutting the film in strips of suitable width, and embedding the strips at least partially into a security paper during paper manufacture.

* * * * *